United States Patent [19]

Charniga

[11] 4,393,633

[45] Jul. 19, 1983

[54] WALL CONSTRUCTION

[76] Inventor: Joseph Charniga, P.O. Box 292, New Middletown, Ohio 44442

[21] Appl. No.: 228,480

[22] Filed: Jan. 26, 1981

[51] Int. Cl.[3] ..... E04B 2/02; E04C 2/80

[52] U.S. Cl. ..... 52/303; 52/407; 52/408; 98/31

[58] Field of Search ..... 52/303, 407, 408; 98/31

[56] References Cited

U.S. PATENT DOCUMENTS

| | | | |
|---|---|---|---|
| 2,118,237 | 5/1938 | Slayter et al. | 52/481 |
| 2,172,048 | 9/1939 | Johnson | 52/407 |
| 2,912,724 | 11/1959 | Wilkes | 52/584 X |
| 3,124,847 | 3/1964 | Charniga, Jr. | 52/481 |
| 3,343,474 | 9/1967 | Sohda et al. | 52/303 X |
| 3,611,653 | 10/1971 | Zinn . | |
| 4,031,681 | 6/1977 | Charniga | 52/408 |
| 4,277,926 | 7/1981 | Sherman et al. | 52/303 |

FOREIGN PATENT DOCUMENTS

| | | | |
|---|---|---|---|
| 2520441 | 11/1976 | Fed. Rep. of Germany | 52/303 |
| 981921 | 1/1965 | United Kingdom | 52/303 |

*Primary Examiner*—Alfred C. Perham
*Attorney, Agent, or Firm*—Harpman & Harpman

[57] ABSTRACT

A wall construction suitable for exterior load bearing walls includes spaced studding positioned vertically between upper and lower plates with the inner surfaces of the studs scalloped so as to present limited areas of contact with lath and plaster or drywall. Insulating board is positioned on the outer continuous surface of the studs with a foam board affixed directly thereto. Siding or the like is positioned on the exterior of the foam board to form the exterior surface of the wall. Insulating bats are positioned within the wall cavity adjacent the insulating board and between the spaced studding. Openings are provided in the interior wall surface to circulate warm air in the interior of the wall cavity. Additional openings are provided in the lower plate of the wall to allow air to circulate from a basement area into the wall cavity. The spaced transversely positioned scallops in the inner surface of the studding substantially isolates the interior wall from the exterior insulating board, foam and exterior siding.

4 Claims, 3 Drawing Figures

FIG. 1
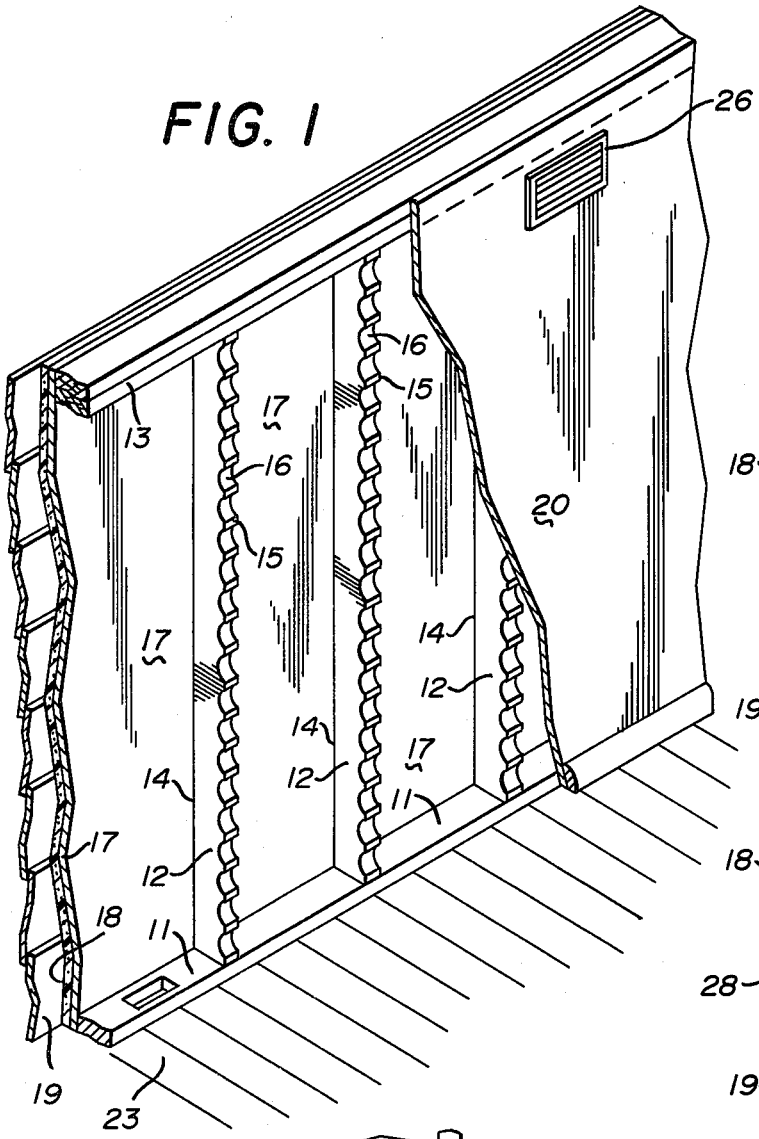
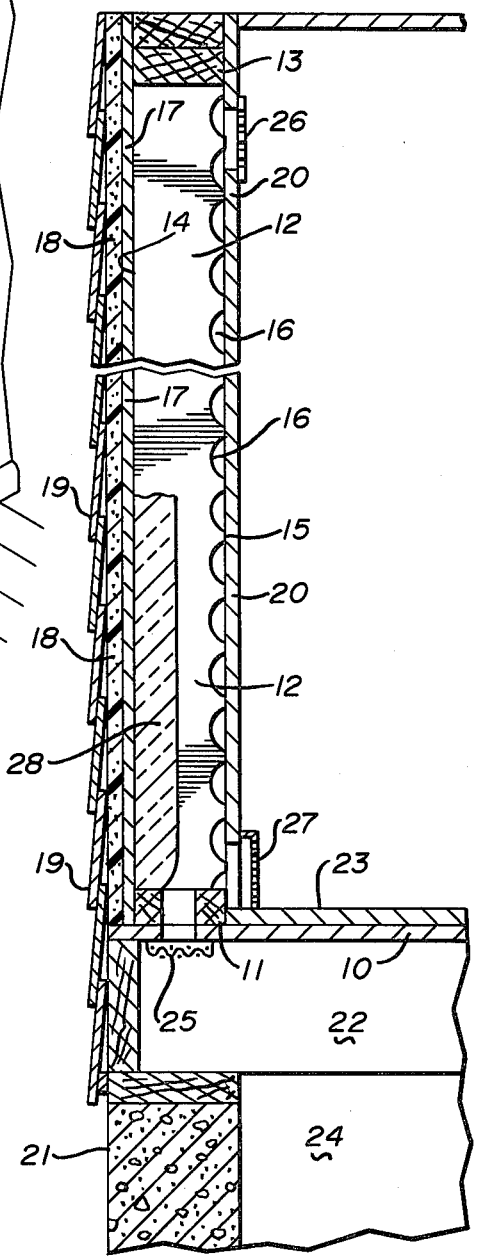
FIG. 2
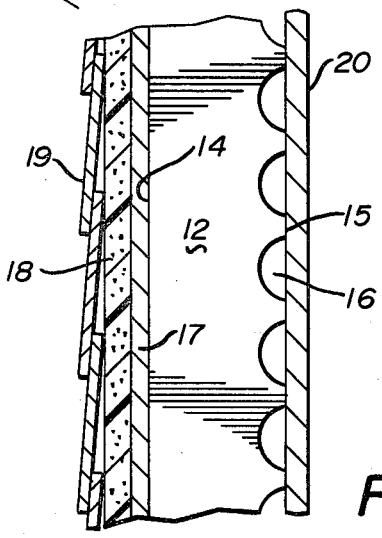
FIG. 3

WALL CONSTRUCTION

BACKGROUND OF THE INVENTION (1) Field of the Invention

This invention relates to wall construction such as used in frame building construction exterior walls and the like.

(2) Description of the Prior Art

Prior art wall structures have usually employed wooden studding with flat inner and outer surfaces and have located the insulating board or sheathing and the lath and plater or drywall directly against the flat surfaces of the studding. A number of different wall constructions have also been proposed in the past. See for example applicant's Pat. No. 4,031,681 and U.S. Pat. Nos. 2,118,237 and 3,611,653.

In applicant's U.S. Pat. No. 4,031,681 a wall construction is disclosed having scalloped exterior surfaces of studding engaging the exterior wall material. The inner surface of the studding is flat onto which drywall or lath and plaster construction is secured.

In U.S. Pat. No. 2,118,237 a partition is shown having studs with many very small grooves in the stud edges thereby decreasing the amount of surface contact with both the inner and outer parts of the wall structure.

In U.S. Pat. No. 3,611,653 a sound attenuation wall partition is disclosed wherein a metal stud system has a series of projecting tabs so that the interior wall is spaced with respect to the studs of the wall. The tabs are provided with foam pads.

The present invention provides an exterior load bearing wall wherein the inner wall material such as lath and plaster or drywall is supported in limited surface contact with the studding allowing circulation of the air between the cavities normally formed by the studs. Additional vent openings are provided in the interior wall material and in the lower plate of the wall so that warm air can circulate within the wall cavity providing a warm wall interior. The limited surface contact between the inner and exterior walls results from the formation of a plurality of closely spaced transverse scallops in the studding. The exterior insulating board, foam and siding therefore remain at the exterior temperature with the inner heated wall being at room temperature.

SUMMARY OF THE INVENTION

A wall construction incorporating spaced vertical studding, the inner surfaces of which are provided with a plurality of transverse shallow scallops in closely spaced relation to one another receives and isolates an interior lath and plater or drywall material from the exterior wall material with a minimum of contact between the studding and the interior wall material. The outer or opposite surface of the studding is flat and directly engaged against insulating board, foam and exterior siding or the like so as to form the isolated exterior wall. Openings are provided in the interior wall and in the lower portion of the wall.

Air circulation is thus provided in the interior of the wall.

DESCRIPTION OF THE DRAWINGS

FIG. 1 is a perspective view of a portion of a wall construction formed in accordance with the invention;

FIG. 2 is a vertical section on an enlarged scale through a wall construction incorporating the invention, and;

FIG. 3 is an enlarged detailed portion of the exterior wall seen in FIG. 1.

DESCRIPTION OF THE PREFERRED EMBODIMENT

By referring to the drawings and FIG. 1 in particular, it will be seen that a wall construction such as an exterior load bearing wall has been disclosed and wherein a subfloor 10 or the like of a building is disclosed and supports a lower plate 11 with a plurality of studding 12 standing vertically thereon in spaced relation to one another and extending upwardly and receiving a double upper plate construction 13 on their uppermost ends. Each of the studding 12 has a flat outer surface 14 and a contoured interior surface 15 formed by a plurality of closely spaced transversely arranged shallow scallops 16. The lower plate 11, the double upper plate 13 and the studding 14 are formed of 2×4's as known in the art.

An insulating fiberboard 17 is positioned on the flat outer surfaces 14 of the studding 12 with a foam board 18 secured to the exterior surface of the insulating board 17. Exterior siding 19 or the like is attached to the foam board 18 by fasteners which pass through the foam board and insulating board respectively to the studding 12. An interior wall 20, shown as being formed of drywall, is secured to the studding 12 between the transversely arranged shallow scallops 16.

Referring to FIG. 2 of the drawings, a basement wall 21 is seen supporting a joist member 22 onto which the subfloor 10 is resting. A finished floor 23 is positioned on top of the subfloor 10 adjacent the lower plate 11 of the wall structure. A basement area 24 can be seen to communicate with the interior of the wall construction through an opening in the lower plate 11 and subfloor 10 covered with a fire screen 25. Openings in the interior wall 20 have grills 26 and 27 secured thereon to allow the passage of interior air into and through the wall structure. An insulating bat 28 is positioned within the wall construction and is preferably of a type having a foil backing which provides a moisture and radiant insulating barrier. The insulation bat 28 is positioned within the wall construction adjacent the exterior wall insulating board 17 and is of a size that allows for an air space between it and the interior wall 20.

Referring now to FIGS. 2 and 3 of the drawings, it will be noted that the temperature of the lath and plaster or interior wall 20 will generally conform with that of the room partially defined thereby in the building construction in which the invention is used. It will also be seen that the circulation of warm air from the interior of the building structure and the basement area 24 into the wall construction provides a cross flow pattern through the contoured interior surface 15 of the studding 12, thereby circulating within the entire wall construction and maintaining the interior wall 20 at the temperature of the room.

The dissipation of heat through the relatively small surface areas defined by the contoured surface 15 of the studding to the exterior wall material is greatly reduced thereby increasing the insulating effectiveness of the wall construction. There is little or no travel of moisture from the inner warm wall to the exterior wall because they are at substantially the same temperature. The present invention therefore primarily relates to the formation of an exterior bearing wall construction which is internally warm and which forms a weather and temperature barrier from the exterior thereof by reason of the siding 19, the air spaces therebeneath and relatively thick foam board 18 and insulating board 17 and the insulating bat 28, all of which is in very limited contact with the interior wall 20 by reason of the transversely arranged shallow scallops 16 in the studding 12. This also stops sound transmission.

It will be understood that scallops can be formed in the inner surfaces of the plates 11 and 13 so that the interior wall 20 is further isolated from the remainder of the wall construction.

Although but one embodiment of the present invention has been illustrated and described, it will be apparent to those skilled in the art that various changes and modifications may be made therein without departing from the spirit of the invention and having thus described my invention what I claim is:

1. An improvement in an exterior load bearing wall construction having horizontally spaced vertically standing studding and outer and inner wall portions supported thereon, said improvement comprising the formation of said outer wall portion consisting of at least two layers of insulating board and at least one layer of insulating batting and an exterior surfacing material, a plurality of closely spaced scallops formed in the inner surfaces of said studding to form narrow transverse areas therebetween, said inner wall portion comprising dry wall and the like positioned against said narrow transverse portions of said studding, upper and lower plates positioned on the upper and lower ends of said studding, said outer wall portion extending only partially into areas of said wall construction between said studding so as to provide air spaces between said outer wall portion and said inner wall portion and openings in said inner wall portion for ventilating said air spaces.

2. The improvement in an exterior load bearing wall construction set forth in claim 1 and wherein openings are formed in said lower plate to provide increased ventilation in said air spaces.

3. The improvement in an exterior load bearing wall construction set forth in claim 1 and wherein said layer of insulating batting of said outer wall portion has a foil backing providing a moisture and radiant insulating barrier facing said inner wall portion.

4. The improvement in an exterior load bearing wall construction set forth in claim 1 and wherein said openings in said inner wall portion are arranged in the upper and lower portions thereof respectively so as to provide a thermal actuated flow of ventilating air through said air spaces.

* * * * *